US008638027B2

(12) United States Patent
Van Dijk et al.

(10) Patent No.: US 8,638,027 B2
(45) Date of Patent: Jan. 28, 2014

(54) LIGHTING ARMATURE

(75) Inventors: Hans Klaas Van Dijk, Sittard (NL); Franciscus Van Vehmendahl, Sittard (NL); Robert Hendrik Catharina Janssen, Beek (NL)

(73) Assignee: DSM IP Assets B.V., Heerlen (NL)

( * ) Notice: Subject to any disclaimer, the term of this patent is extended or adjusted under 35 U.S.C. 154(b) by 1088 days.

(21) Appl. No.: 12/443,768

(22) PCT Filed: Oct. 10, 2007

(86) PCT No.: PCT/EP2007/008806

§ 371 (c)(1),
(2), (4) Date: Nov. 5, 2009

(87) PCT Pub. No.: WO2008/043540

PCT Pub. Date: Apr. 17, 2008

(65) Prior Publication Data

US 2011/0279035 A1 Nov. 17, 2011

(30) Foreign Application Priority Data

Oct. 12, 2006 (EP) ..... 06021403

(51) Int. Cl.
*F21V 29/00* (2006.01)
*H01J 61/52* (2006.01)
*H01J 7/24* (2006.01)

(52) U.S. Cl.
USPC ..... 313/46; 310/16; 310/52; 362/294; 362/373; 315/112

(58) Field of Classification Search
None
See application file for complete search history.

(56) References Cited

U.S. PATENT DOCUMENTS

| | | | | |
|---|---|---|---|---|
| 6,048,919 | A | 4/2000 | McCullough | |
| 6,251,976 | B1 | 6/2001 | Scholl et al. | |
| 6,318,886 | B1 | 11/2001 | Stopa et al. | |
| 6,402,347 | B1 * | 6/2002 | Maas et al. | 362/294 |
| 2002/0149312 | A1 * | 10/2002 | Roberts et al. | 313/495 |
| 2004/0252502 | A1 | 12/2004 | McCullough et al. | |
| 2007/0062032 | A1 * | 3/2007 | Ter-Hovhannissian | 29/840 |

FOREIGN PATENT DOCUMENTS

WO 00/36336 6/2000

OTHER PUBLICATIONS

International Search Report for PCT/EP2007/008806, mailed Jan. 16, 2008.
Written Opinion of the International Searching Authority for PCT/EP2007/008806, mailed Jan. 16, 2008.
Shermanl M, "Plastics That Conduct Heat", [Online] www.ptonline.com/articles/200106fa1.html, Jun. 30, 2001, XP007901800.
Sherman, L. M, "Plastics That Conduct Heat", [Online] www.ptonline.com/articies/200106fa1.html, Jun. 30, 2001, XP007901800.

* cited by examiner

*Primary Examiner* — Ashok Patel
(74) *Attorney, Agent, or Firm* — Nixon & Vanderhye P.C.

(57) ABSTRACT

The invention relates to a lighting armature or light generator, comprising a housing, a light source and drive electronics for driving the light source, wherein the having cooling fins made of a plastic composition having an orientation averaged thermal conductivity of at least 2.0 W/m·K.

10 Claims, 1 Drawing Sheet

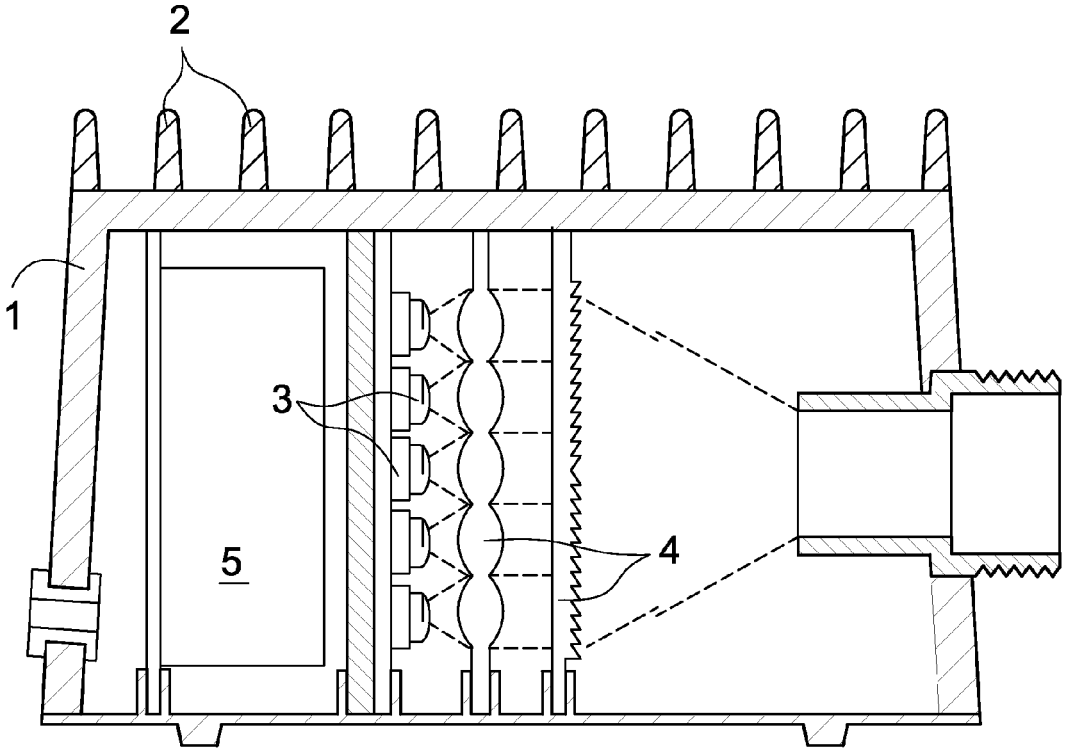
2
1
3
5
4

LIGHTING ARMATURE

FIELD

The invention relates to a lighting armature comprising a housing accommodating a light source and drive electronics for driving the light source.

BACKGROUND AND SUMMARY

Such lighting armatures are known per se. Sometimes these lighting armatures are also called light armature or light generator. They are used, inter alia, for general lighting purposes, for so-called sign and contour illumination, and for signal illumination, such as in traffic lights or traffic-control systems, for example in road-marking systems for dynamically or statically controlling traffic flows. Such light generators are further used in projection illumination and in fiber-optical illumination.

A lighting armature of the type mentioned above is known from U.S. Pat. No. 6,402,347-B1. The known lighting armature is provided with a LED light source having a luminous flux of at least 5 lm during operation and a plastic optical lens system for directing the radiation to be generated by the light source.

According to U.S. Pat. No. 6,402,347-B1, the possibility for the use of an optical system made from a synthetic resin material is based on the recognition that light-emitting diodes (LEDs) generate much less radiation heat and/or UV light than conventional light sources such as gas discharge lamps or halogen lamps. Since the LEDs can be chosen such that they emit little or no UV and/or IR-radiation, LEDs are eminently suitable for use in light engines. A further advantage of the use of LEDs is the compactness of such light sources. This advantage is used in practice to combine a plurality of LEDs in the lamp source and/or to make even more compact lighting armatures. These advantages could be useful for making compact lighting armatures with a plurality of LEDs for household and office lighting applications, wherein the housing not only functions as a cover for the electronic parts, but also can be given a decorative function. Although it is mentioned in U.S. Pat. No. 6,402,347-B1 that in principle, it is also possible to arrange the drive electronics outside the housing, it is to be noted that for household and office lighting applications the drive electronics generally will have to be incorporated in the housing.

A problem with electronic lamps, comprising electronic parts for controlling the light source, and in particular with multi-LED solid state lamps, is that the light source produces heat, which, if not adequately removed affects the performance of the light source and/or of the electronic parts, and as an effect thereof, the control of the light source and the light production is interfered with, and the lifetime of the light source is reduced.

Although, as stated in U.S. Pat. No. 6,402,347-B1, the heat emitted by a single LED is limited, in a multi LED system this heat can be sufficient to heat the LEDs and the drive electronics and thereby affect the performance of the light source driven by the drive electronics. This is particularly the case with multi-LED light sources comprised in compacted lighting armatures. Moreover, in electronic lamps wherein the housing is designed as a shell, such as a tubular hull made of metal, e.g. aluminum or steel, the heat removal is too low. To limit heating of the parts comprised by the housing, the known lighting armature of U.S. Pat. No. 6,402,347-B1 comprises a metal housing provided with cooling fins, or comprises means to apply forced air cooling, for example a fan incorporated in the housing by which an air stream can be generated. In the latter case the housing can be made of a synthetic resin.

A disadvantage of the known lighting armature is that incorporation of a fan makes the construction of the lighting armature more complex, apart from the fact that in compacted lighting armatures there is often no space for such a fan. A disadvantage of the metal housing with cooling fins is that such a housing is difficult to produce and thereby expensive, heavy in weight and, most importantly, introduces the risk of short circuitry and dielectrical breakdown. This problem is becoming even more critical since the lighting armatures with multi/LED systems could do a great job for domestic lighting purposes as well, but therefore have to comply with stringent norms on safety including high threshold values for dielectric breakdown.

The aim of the invention is to provide an electronic lamp, which does not have the said problems, or at least in lesser extent. More particularly, the aim of the invention is to provide a lighting armature, that is suitable for domestic lighting purposes which has improved balance in heat management properties and weight, no internal forced air cooling needs to be applied and higher security levels can be obtained.

This aim is has been achieved with the lighting armature according to the invention, wherein the housing has cooling fins made of a plastic composition having an orientation averaged thermal conductivity of at least 2.0 W/m·K.

The effects of the lighting armature according to the invention, having said cooling fins are that the threshold values for short circuitry and dielectric breakdown are increased compared to a corresponding lighting armature made of metal. Moreover, already by using cooling fins made of a polymer composition with such a low thermal conductivity, a substantially heat reduction can be achieved that internal forced air cooling can be dispensed with and weight can be saved. The plastic cooling fins also attribute to the safety aspects of the lighting armature in that these allow the lighting armature to be handled by touching the cooling fins rather than the electrically conductive metal shield.

BRIEF DESCRIPTION OF THE DRAWING

The FIGURE depicts an exemplary lighting armature having a housing provided with cooling fins, a light source within the housing, and drive electronics within the housing for driving the light source.

DETAILED DESCRIPTION

As shown in the FIGURE, the housing 1 in the lighting assembly according to the invention can accommodate a light source 3 (preferably in the form of LEDs) and drive electronics 5 for driving the light source. Lenses 4 may be placed in front of the light source 3. Suitably, the housing 1 accommodates the light source 3 and the drive electronics 5 within walls being part of the housing. Cooling fins 2 present in said housing typically are not suited for accommodating the light source 3 and the drive electronics 5 as they generally will protrude from the walls, in a direction away from the heat source. The fins 2 may protrude from the walls, in a direction about perpendicular to the walls, as is illustrated in the FIGURE and in FIG. 1 of U.S. Pat. No. 6,402,347 cited above. Cooling fins 2 thus also differ from other structural elements in the housing 1, such as the housing walls, in that the walls and other structural elements will be heated from one side by the heat source and will dissipate the heat from the other side, while the cooling fins will be heated by conduction of heat from the other structural elements of the housing 1 through the bulk of the material from which the fins are made and will dissipate the heat from both lateral sides of the cooling fins.

The effects of the said cooling fins 2 in the lighting armature according to the invention can be further enhanced by different embodiments of the inventive lighting armature described below.

The thermal conductivity of a plastic composition is herein understood to be a material property, which can be orientation dependent. For determining the thermal conductivity of a plastic composition, that material has to be shaped into a shape suitable for performing thermal conductivity measurements. Depending on the composition of the plastic composition, the type of shape used for the measurements, the shaping process as well as the conditions applied in the shaping process, the plastic composition may show an isotropic thermal conductivity or an anisotropic, i.e. orientation dependent thermal conductivity. In case the plastic composition is shaped into a flat rectangular shape, the orientation dependent thermal conductivity can generally be described with three parameters: $\Lambda_{\perp}$, $\Lambda_{//}$ and $\Lambda_{\pm}$. The orientationally averaged thermal conductivity ($\Lambda_{oa}$) is herein defined according to formula (I):

$$\Lambda_{oa}=1/3\cdot(\Lambda_{\perp}+\Lambda_{//}+\Lambda_{\pm}), \quad \text{(I)}$$

wherein

- $\Lambda_{\perp}$ is the through-plane thermal conductivity, also indicated herein as perpendicular thermal conductivity,
- $\Lambda_{//}$ is the in-plane thermal conductivity in the direction of maximum in-plane thermal conductivity, also indicated herein as parallel or longitudinal thermal conductivity and
- $\Lambda_{\pm}$ is the in-plane thermal conductivity in the direction of minimum in-plane thermal conductivity, also indicated herein as transversal thermal conductivity.

The number of parameters can be reduced to two or even to one depending on whether the thermal conductivity is anisotropic in all three directions, deviating in only one of the three directions or even isotropic. In case of a plastic composition with a dominant unidirectional orientation of thermal conductive fibres in one orientation, $\Lambda_{//}$ can be much higher than $\Lambda_{\pm}$, whereas $\Lambda_{\pm}$ might be very close or even equal to $\Lambda_{\perp}$. In the latter case the definition of the orientationally averaged thermal conductivity ($\Lambda_{oa}$) reduces to formula (II):

$$\Lambda_{oa}=1/3\cdot(2\cdot\Lambda_{\perp}+\Lambda_{//}) \quad \text{(II)}$$

In case of a plastic composition with a dominant parallel orientation of plate-like particles in plane with the planar orientation of the plate, the plastic composition may show an isotropic in-plane thermal conductivity, i.e. $\Lambda_{//}$ is equal to $\Lambda_{\pm}$. In that case $\Lambda_{//}$ and $\Lambda_{\pm}$ can be represented by one parameter, $\Lambda_{=}$ and the definition of the orientationally averaged thermal conductivity ($\Lambda_{oa}$) reduces to formula (III):

$$\Lambda_{oa}=1/3\cdot(\Lambda_{\perp}+2\cdot\Lambda_{=}) \quad \text{(III)}$$

In case of a plastic composition with an overall isotropic thermal conductivity, $\Lambda_{\perp}$, $\Lambda_{//}$ and $\Lambda_{\pm}$ are all equal and identical to the isotropic thermal conductivity $\Lambda$. In that case the definition of the orientationally averaged thermal conductivity ($\Lambda_{oa}$) reduces to formula (IV)

$$\Lambda_{oa}=\Lambda \quad \text{(IV)}$$

The orientationally averaged thermal conductivity can be determined by measurement of the orientation dependent thermal conductivities $\Lambda_{\perp}$, $\Lambda_{//}$ and $\Lambda_{\pm}$. For measurement of $\Lambda_{\perp}$, $\Lambda_{//}$ and $\Lambda_{\pm}$, samples with dimensions of 80×80×1 mm were prepared from the material to be tested by injection moulding using an injection moulding machine equipped with a square mould with the proper dimensions and a film gate of 80 mm wide and 1 mm high positioned at one side of the square. Of the 1 mm thick injection molded plaques the thermal diffusivity D, the density (ρ) and the heat capacity (Cp) was determined.

The thermal diffusivity as used in the present invention was determined in a direction in-plane and parallel ($D_{//}$) and in-plane and perpendicular ($D_{\pm}$) to the direction of polymer flow upon mold filling, as well as through plane ($D_{\perp}$), according to the ASTM method E1461-01 with Netzsch LFA 447 laser-flash equipment. The in-plane thermal diffusivities $D_{//}$ and $D_{\pm}$ were determined by first cutting small strips or bars with an identical width of about 1 mm wide from the plaques. The length of the bars was in the direction of, respectively perpendicular to, the polymer flow upon mold filling. Several of these bars were stacked with the cut surfaces facing outwards and clamped very tightly together. The thermal diffusivity was measured through the stack from one side of the stack formed by an array of cut surfaces to the other side of the stack with cut surfaces.

The heat capacity (Cp) of the plates was determined by comparison to a reference sample with a known heat capacity (Pyroceram 9606), using the same Netzsch LFA 447 laser-flash equipment and employing the procedure described by W. Nunes dos Santos, P. Mummery and A. Wallwork, Polymer Testing 14 (2005), 628-634.

From the thermal diffusivity (D), the density (ρ) and the heat capacity (Cp), the thermal conductivity of the molded plaques was determined in a direction parallel ($\Lambda_{//}$) and perpendicular ($\Lambda_{\pm}$) to the direction of polymer flow upon mold filling, as well as perpendicular to the plane of the plaques ($\Lambda_{\perp}$), according to formula (V):

$$\Lambda_x=D_x*\rho*Cp \quad \text{(V)}$$

wherein x=//, ± and ⊥, respectively.

The orientationally averaged thermal conductivity of the plastic composition of which the cooling fins of the housing for the lighting armature according to the invention, or any other part or parts thereof, is made can vary over a wide range. Preferably, the orientationally averaged thermal conductivity is at least 2 W/m·K, more preferably at least 5 W/m·K, and still more preferably at least 10 W/m·K. The advantage of a higher minimal orientationally averaged thermal conductivity is that the problem of heating of the light source and eventually the internal parts of the lighting system is further reduced.

The orientationally averaged thermal conductivity of the plastic composition may be as high as 50 W/m·K and even higher, but an orientationally averaged thermal conductivity value over 50 W/m·K does not give a significant additional contribution to the heat dissipation. Furthermore, plastic compositions with such a high thermal conductivity generally have low mechanical and/or bad flow properties making these materials less suitable for making the cooling fins of the housing, and any other parts thereof, at least not as an integral part. In line with that the plastic composition of which the housing or parts thereof according to the invention, or preferred embodiments thereof, is made preferably has an orientationally averaged thermal conductivity of at most 50 W/m·K, more preferably at most 30 W/m·K and still more preferably at most 25 W/m·K. Very suitably, the orientationally averaged thermal conductivity is in the range of 10-25, preferably 15-20 W/m·K. The advantage is that the problem of heating of the drive electronics is already substantially reduced when the cooling fins of the housing is made of a plastic composition having such limited orientationally averaged thermal conductivity, compared to a housing fully made of a metal with a thermal conductivity of around 150 W/m·K.

Preferably, the cooling fins are made from a thermoplastic material having a through-plane conductivity in the range of 1 to 10 W/mK and the cooling fins have height (H) and thickness (T) dimensions wherein the H/T ratio is at least 3:1.

Although it is mostly true that a higher H/T ratio of the cooling fins improve the heat dissipating effect, practical considerations may limit the H/T ratio. Fins having excessive heights do not provide a further improvement of the heat dissipation effect; the present material is not sufficiently thermally conductive for very high fins to suck up the heat all the way to the top. From the viewpoint of mechanical stability and ease of manufacturing the preferred H/T ratio of the cooling fins is in the range of 3:1 to 10:1; more preferably the H/T ratio is in the range of 5:1 to 8:1.

For reasons concerning production technology and mechanical stability the minimum thickness of the cooling fins is preferably 0.2 mm, more preferably 0.3 mm, and even more preferably 0.5 mm. Most preferably, the thickness of the cooling fins is about 1 mm.

Depending on the intended use of the lighting armature, respectively, the maximum height of the cooling fins is preferably 20 mm.

Limiting the absolute dimensions allows a high number of cooling fins per unit surface area (dense packing of the fins) and accordingly, the cooling surface area per unit weight of the housing can be high, while the overall dimensions of the housing can be kept limited. This is in particular favourable for applications where there is limited space for positioning the lighting armature. In order to maximize the heat dissipating effect it is preferred to pack the fins as close as possible; however, a certain minimum distance between the fins is determined by a value below which the heat convection may be disturbed and the surface area of the fins may be no longer accessible to flowing cooling air.

The cooling fins are typically protruding from the outer surface of the main body of the housing. They need not be uniformly distributed over the housing. It rather may be advantageous to design the housing of the present lighting armature in a way that the cooling fins are primarily located where they are most effective, i.e. near to the light source(s) emitting the heat to be dissipated.

The position, number and actual dimensions (including thickness, height, and length) of the cooling fins of the housing can be determined by the person skilled in the art of making plastic products based on experience and by routine testing. Fine tuning of these variables is amongst others governed by the desired heat dissipating effect and the production method and material of the housing.

It is noted that, in principle, the light source can be any light source with an electronic drive system, and suitable may be a conventional light source, but preferably comprises one or more LEDs. Preferably the light source is constituted of a plurality of LEDs mounted on a printed circuit board, more preferably a metal core printed circuit board, (MC-PCB).

It is possible to manufacture unicolored light generators which are provided with a single LED. In practice, a substrate with a plurality of LEDs as the light source of the light generator will be employed in many cases. This applies, in particular, if the desired color of the light generator can be obtained only by mixing the colors of different types of LEDs.

Further advantages of the use of LEDs are the compactness of such light sources, a relatively very long service life, and the relatively low costs of energy and maintenance of a light engine comprising LEDs. The use of LEDs also has the advantage that dynamic lighting possibilities are obtained. If different types of LEDs are combined and/or LEDs of different color are used, colors can be mixed in the desired manner and color changes can be effected without the use of a so-called color wheel being necessary. The desired color effects are achieved by using suitable drive electronics. In addition, a suitable combination of LEDs enables white light to be obtained, whereby drive electronics enable a desired color temperature to be adjusted, which color temperature remains constant during operation of the light generator.

LED is preferably mounted on a metal-core printed circuit board (MC-PCB). When the LED(s) is (are) provided on such a metal-core printed circuit board, the heat generated by the LED or the LEDs can be readily dissipated away from the LEDs via the PCB by means of heat conduction. Although this cannot prevent heating of the internal parts comprised in the lighting armature to a certain extent, the MC-PCB is advantageously used to dissipate heat via the housing in the present invention.

The drive electronics of the lighting armature according to the invention may comprise means for changing the luminous flux of the LED. By using this measure, it is possible for example to dim the luminous flux.

In a favorable embodiment of the invention, the lighting armature comprises a light source consisting of LEDs which can generate radiation of different wavelengths, and wherein the drive electronics comprise means for adjusting the ratio between the luminous fluxes of the LEDs. This measure enables the color and the color temperature of the light emitted by the light generator to be changed. By using suitable drive electronics, it becomes also possible, to make, for example, white light of a constant color temperature.

The housing that is comprised in the lighting armature according to the invention can be constituted of different parts and constructions.

In a preferred embodiment, the housing comprises a metal shield with a first surface, i.e. the surface oriented towards the drive electronics, and a second surface, i.e. the surface directed towards the cooling fins, and wherein the metal plate and the cooling fins are in direct heat conductive contact.

Such a direct heat conductive contact can be achieved, for example, by moulding the cooling fins directly onto the second surface of the metal shield, or by adhering the cooling fins with a heat conductive adhesive onto the said surface. The plastic cooling fins attribute to the safety aspects of the lighting armature in that these protect the metal shield from touching and allow the lighting armature to be handled by touching the cooling fins rather than the electrically conductive metal shield. This effect is enhanced when the cooling fins are made of a heat conductive electrically insulating plastic material.

Another solution for accomplishing the direct heat conductive contact is a construction wherein the housing comprises a plastic layer or shield, made of a heat conductive plastic material, the plastic shield having a first surface facing towards the metal shield and being in direct heat conductive contact with the metal shield, and a second surface, facing away from the metal shield and bearing the plastic cooling fins.

The presence of the said plastic shield in this solution made of a heat conductive electrically insulating plastic material further adds to the safety of the lighting armature.

The housing comprising the metal shield is suitably combined with a metal-core printed circuit board (MC-PCB) multi LED system in contact with the metal shield via a heat-conducting connection. Such a heat-conducting connection is preferably realized by mounting the MC-PCB on a metal plate which is connected to the metal shield. In this embodiment, the heat generated in the LED or LEDs can be dissipated by (thermal) conduction via the MC-PCB and the metal plate to the housing and the cooling fins, where after heat-dissipation to the surroundings takes place.

More preferably, the heat-conducting connection is accomplished by means of a connecting element made of a heat conductive electrically insulating material. This has the advantage that the risk of electrical short circuitry is reduced, or otherwise that in case of short circuitry in the electrical system of the lamp any electrically conductive parts in the housing cannot be charged.

Suitably, the heat conductive electrically insulating material is positioned between the MC-PCB and the metal plate to which the MC-PCB is connected.

Elaborating further on one of the solutions mentioned above, other than moulding or adhering the cooling fins made of the thermally conductive plastic on a metal shield, the cooling fins can also constitute elongated elements of a plastic body comprising a plastic shield having a surface from which the elongated elements protrude. The plastic body suitably is an integrally moulded part made of a heat conductive plastic composition. This plastic body is advantageously combined with the metal shield as described above.

In a preferred embodiment the plastic body is an integrally moulded part made of a plastic composition having an orientation averaged thermal conductivity of more than 20 W/m·K. The advantage of this embodiment is that the heat dissipation from the lighting armature is so large that in particular cases, a metal shield as described above can be dispensed with. The higher the heat conductivity of the plastic composition from which the integrally moulded plastic body comprising the cooling fins, the larger the heat production of the lighting armature can be, without the need of such a metal shield as part of the housing.

In another preferred embodiment of the invention, the plastic body is a 2K moulded part comprising a layer made of a first plastic composition having an orientation averaged thermal conductivity of more than 20 W/m·K, and fins made of a second plastic composition having an orientation averaged thermal conductivity of 2.0-20 W/m·K.

The advantage of this embodiment is that the housing has improved mechanical properties while retaining good heat dissipation properties.

Also preferably, the housing made of the 2K moulded part or the integrally moulded part, as described above, is suitably combined with a metal-core printed circuit board (MC-PCB) multi LED system, wherein the layer made of a first plastic composition having an orientation averaged thermal conductivity of more than 20 W/m·K, respectively the integrally moulded part made of said plastic composition, is in contact with the metal shield via a heat-conducting connection. The advantages of the lighting armature with this construction are the same as for the construction with the metal shield and MC-PCB multi LED system in heat-conducting connection, described above.

The lighting armature according to the invention favourably comprises a plurality of LEDs, and optionally combined with an optical system comprising a collimator lens and/or a focusing lens.

The collimator lens suitably is composed of a plurality of sub-lenses or of a plurality of collimating elements, each LED being associated with one sub lens or collimating element an optical axis of each of the sub-lenses, or respectively the collimating elements, coinciding with an optical axis of one of the LEDs.

By means of this optical construction, the light from a number of LEDs can be satisfactorily focused. Suitably, the sub-lenses or collimating elements of the collimator lens is made from a transparent synthetic resin material (for example PMMA).

The focusing lens is a Fresnel lens. This contributes to the compactness of the light generator. Such a Fresnel lens is suitably made of a synthetic material, for example PMMA, wherein the desired optical Fresnel structure is obtained by means of injection molding.

Apart from the housing, the light source, the drive electronics, and the optional optical system, a lighting armature typically accommodates parts of electrical power supply means. Such electrical power supply means are critical sources for short circuitry problems, thereby constituting a source for safety risks.

In a preferred embodiment of the invention, the lighting armature accommodates an electrically insulating plastic shield made of an electrically insulating material, whereby the electrically insulating plastic shield is positioned in between the parts of the electrical power supply means on one side, and the housing with a part or parts thereof made of thermally conductive material, on the other side.

The advantage of this embodiment is that the threshold voltage for dielectric breakdown is further increased and a housing with better heat conductive material and optionally fully made of electrically conductive material can be used. A further advantage is that the tests the lighting armature has to be subjected to are much less in order to comply with the various international norms on electronic enclosure technology.

An electrically insulating material is herein understood a material that has a specific electrical resistance of at least $10^4$ Ohm·m. Preferably, the electrically insulating material has a specific electrical resistance of at least $10^5$ Ohm·m, and more preferably at least $10^7$ Ohm·m, or even at least $10^{10}$ Ohm·m. The specific electrical resistance may be as high as $10^5$ Ohm·m or even higher.

Suitably, the electrically insulating material is a heat resistant polymeric material. Suitable the heat resistant polymeric material consists of or comprises a heat resistant polymer, such as semi-crystalline polymers with a high melting temperature (Tm), or amorphous polymers with a high glass transition temperature (Tg). Preferably, the Tg, respectively the Tm, is at least 180° C., 200° C., or even 220° C.

Suitable polymers that can be used in the electrically insulating material are, for example, semi-crystalline polyesters such as PBT.

The electrically insulating plastic shield can suitably be positioned near or against a surface area of the housing, being a surface area facing towards the drive electronics and the parts electrical power supply means.

In a preferred embodiment of the invention, the electrically insulating plastic shield constitutes an integrated part of the housing. This embodiment can be realized by means of the housing being a 2K moulded part, wherein the 2K moulded part comprises a shield and cooling fins protruding from the shield, wherein the shield comprising 2 layers, a first layer from which the fins protrude, the first layer and the cooling fins integrally moulded from the heat conductive plastic material, and a second layer positioned opposite to the cooling fins moulded from an electrically insulating material.

Apart from the reduced safety risk, this embodiment has the advantage that the heat conductive part of the housing can be made from heat conductive material that has a higher heat conductive, while retaining good mechanical properties and integrity.

The electrically insulating plastic shield, as well as the parts of the housing constituted by the heat conductive plastic body bearing the heat conductive plastic cooling fins and the optional metal shield used therein, can have any shape that is suitable for the lighting armature. Suitable shapes for all these parts are, for example, planar, concave, convex, cylindrical, funnel, or bulb, or any combination thereof. The cylindrical, funnel, trapezoid, or bulb shaped parts suitably have a circular, ellipsoid, or polygonal cross section, or any combination thereof. Suitable polygonal cross sections are, for example, rectangular, pentagonal, hexagonal, and trapezoid. The housing may also be shaped in any decorative shape or colour. Also the dimensions of the cooling fins in the housing, including the thickness, length and height, can be determined by the person skilled in the art of making heat dissipating parts based on experience and by systematic research and routine testing. Fine tuning of these dimensions for enabling production of the part of the housing comprising the cooling fins, can be done by the person skilled in the art of making injection moulded parts based on experience and by systematic research and routine testing.

In a particular embodiment of the lighting armature according to the invention the housing consists of two parts, an inner tubular part made of metal and an external part provided with cooling fins made of a heat conductive polymer. The external part suitably comprises a cylindrical hole fitting over part of the inner tubular part, or the external part consists of smaller individual parts, which can be fitted around part of the inner tubular part.

The invention also relates to a housing for a lighting armature. The housing according to the invention comprises cooling fins made of a plastic composition having an orientation averaged thermal conductivity of at least 2.0 W/m·K, as well as to preferred embodiments thereof as described above.

The invention also relates to a method for assembling a lighting armature. The inventive method comprises assembling a light source, drive electronics for driving the light source, electrical power supply means, and a plastic part made of a plastic composition having an orientation averaged thermal conductivity of at least 2.0 W/m·K and comprising a plastic shield having a surface from which elongated elements protrude, and optionally a metal shield and/or a electrically insulating plastic shield, such that the plastic part constitutes a housing, or a part thereof, accommodating the light source and the drive electronics.

Favorably, the method comprises a step, wherein the metal shield having an inner face and an outer face is positioned with the inner face oriented towards the drive electronics and wherein the outer face are fixed in heat conductive contact with a surface of the plastic part opposite to the surface from which elongated elements protrude.

Also favorably the lighting armature made by that method is a lighting armature according to any of the preferred embodiments described above.

For making the cooling fins, and optionally other parts of the housing for the lighting armature according to the invention a thermally conductive plastic composition is used. Although for the thermally conductive plastic composition a thermally conductive polymer may be used, such materials are not widely available and generally very expensive. Suitably, the thermally conductive plastic composition comprises a polymer and thermally conductive material dispersed in the polymer. The plastic composition may comprise, next to the polymer material and the thermally conductive material, other components. As the other components, the thermally conductive material may comprise any auxiliary additive used in conventional plastic compositions for making moulded plastic parts.

The polymer in the thermally conductive plastic composition used in the lighting armature according to the invention can in principle be any polymer that is suitable for making thermal conductive plastic compositions. Suitably, the polymer shows a good heat resistance at the use temperature of the intended lighting armature. The polymer that is used can be any thermoplastic polymer that, in combination with the thermally conductive material, and the optional other components, is able to work at elevated temperatures without significant softening or degradation of the plastic and can comply with the mechanical and thermal requirements for the housing. These requirements will depend on the specific application and design of the housing. The compliance with such requirements can be determined by the person skilled in the art of making moulded plastic parts by systematic research and routine testing.

Preferably, the thermally conductive plastic composition in the housing according to the invention has a heat distortion temperature, measured according to ISO 75-2, nominal 0.45 MPa stress applied (HDT-B), of at least 140° C., more preferably at least 180° C., 200° C., 220° C., 240° C., 260° C., or even at least 280° C. The advantage of the plastic composition having a higher HDT is that the housing has a better retention of mechanical properties at elevated temperature and the housing can be used for applications more demanding in mechanical and thermal performance.

Suitable polymers that can be used include thermoplastic polymers and thermoset polymers, such as thermoset polyester resins and thermoset epoxy resins.

Preferably, the polymer comprises a thermoplastic polymer.

The thermoplastic polymer suitably is an amorphous, a semi-crystalline or a liquid crystalline polymer, an elastomer, or a combination thereof. Liquid crystal polymers are preferred due to their highly crystalline nature and ability to provide a good matrix for the filler material. Examples of liquid crystalline polymers include thermoplastic aromatic polyesters.

Suitable thermoplastic polymers that can be used in the matrix are, for example, polyethylene, polypropylene, acrylics, acrylonitriles, vinyls, polycarbonate, polyesters, polyesters, polyamides, polyphenylene sulphides, polyphenylene oxides, polysulfones, polyarylates, polyimides, polyetherketones, and polyetherimides, and mixtures and copolymers thereof.

Suitable elastomers include, for example, styrene-butadiene copolymer, polychloroprene, nitrite rubber, butyl rubber, polysulfide rubber, ethylene-propylene terpolymers, polysiloxanes (silicones), and polyurethanes.

Preferably, the thermoplastic polymer is a chosen from the group consisting of polyesters, polyamides, polyphenylene sulphides, polyphenylene oxides, polysulfones, polyarylates, polyimides, polyethertherketones, and polyetherimides, and mixtures and copolymers thereof.

Suitable polyamides include both amorphous and semi-crystalline polyamides. Suitable polyamides are all the polyamides known to a person skilled in the art, comprising semi-crystalline and amorphous polyamides that are melt-processable. Examples of suitable polyamides according to the invention are aliphatic polyamides, for example PA-6, PA-11, PA-12, PA-4,6, PA-4,8, PA-4,10, PA-4,12, PA-6,6, PA-6,9, PA-6,10, PA-6,12, PA-10,10, PA-12,12, PA-6/6,6-copolyamide, PA-6/12-copolyamide, PA-6/11-copolyamide, PA-6,6/11-copolyamide, PA-6,6/12-copolyamide, PA-6/6,10-copolyamide, PA-6,6/6,10-copolyamide, PA-4,6/6-copolyamide, PA-6/6,6/6,10-terpolyamide, and copolyamides obtained from 1,4-cyclohexanedicarboxylic acid and 2,2,4- and 2,4,4-trimethylhexamethylenediamine, aromatic polyamides, for example PA-6,I, PA-6,1/6,6-copolyamide, PA-6,T, PA-6,T/6-copolyamide, PA-6,T/6,6-copolyamide, PA-6,1/6,T-copolyamide, PA-6,6/6,T/6,1-copolyamide, PA-6,T/2-MPMDT-copolyamide (2-MPMDT=2-methylpentamethylene diamine), PA-9,T, copolyamides obtained from terephthalic acid, 2,2,4- and 2,4,4-trimethylhexamethylenediamine, copolyamide obtained from isophthalic acid, laurinlactam and 3,5-dimethyl-4,4-diamino-dicyclohexylmethane, copolyamides obtained from isophthalic acid, azelaic acid and/or sebacic acid and 4,4-diaminodicyclohexylmethane, copolyamides obtained from caprolactam, isophthalic acid and/or terephthalic acid and 4,4-diaminodicyclohexyl-methane, copolyamides obtained from caprolactam, isophthalic acid and/or terephthalic acid and isophoronediamine, copolyamides obtained from isophthalic acid and/or terephthalic acid and/or other aromatic or aliphatic dicarboxylic acids, optionally alkyl—substituted hexamethylenediamine and alkyl-substituted 4,4-diaminodicyclohexylamine, and also copolyamides and mixtures of the aforementioned polyamides.

More preferably, the thermoplastic polymer comprises a semi-crystalline polyamide. Semi-crystalline polyamides have the advantage of having good thermal properties and mould filling characteristics.

Also still more preferably, the thermoplastic polymer comprises a semi-crystalline polyamide with a melting point of at least 200° C., more preferably at least 220° C., 240° C., or even 260° C. and most preferably at least 280° C. Semi-crystalline polyamides with a higher melting point have the advantage that the thermal properties are further improved.

With the term melting point is herein understood the temperature measured by DSC with a heating rate of 5° C. falling in the melting range and showing the highest melting rate.

Preferably a semi-crystalline polyamide is chosen from the group comprising PA-6, PA-6,6, PA-6,10, PA-4,6, PA-11, PA-12, PA-12,12, PA-6,I, PA-6,T, PA-6,T/6,6-copolyamide, PA-6,T/6-copolyamide, PA-6/6,6-copolyamide, PA-6,6/6,T/6,1-copolyamide, PA-6,T/2-MPMDT-copolyamide, PA-9,T, PA-4,6/6-copolyamide and mixtures and copolyamides of the aforementioned polyamides. More preferably PA-6,I, PA-6,T, PA-6,6, PA-6,6/6T, PA-6,6/6,T/6,1-copolyamide, PA-6,T/2-MPMDT-copolyamide, PA-9,T or PA-4,6, or a mixture or copolyamide thereof, is chosen as the polyamide. Still more preferably, the semi-crystalline polyamide comprises PA-4,6.

For the thermally conductive material in the thermally conductive plastic composition any material that can be dispersed in the thermoplastic polymer and that improves the thermal conductivity of the plastic composition can be used. Suitable thermally conductive materials include, for example, aluminium, alumina, copper, magnesium, brass, carbon, silicon nitride, aluminium nitride, boron nitride, zinc oxide, glass, mica, graphite, and the like. Mixtures of such thermally conductive materials are also suitable.

The thermally conductive material may be in the form of granular powder, particles, whiskers, short fibres, or any other suitable form. The particles can have a variety of structures. For example, the particles can have flake, plate, rice, strand, hexagonal, or spherical-like shapes.

The thermally conductive material suitably is a thermally conductive filler or a thermally conductive fibrous material, or a combination thereof. A filler is herein understood to be a material consisting of particles with an aspect ratio of less than 10:1. Suitably, the filler material has an aspect ratio of about 5:1 or less. For example, boron nitride granular particles having an aspect ratio of about 4:1 can be used.

In a preferred embodiment of the invention, the thermally conductive filler comprises boron nitride. The advantage of boron nitride as the thermally conductive filler in the plastic composition from which the housing is made is that it imparts a high thermal conductivity while retaining good electrical insulating properties.

A fibre is herein understood to be a material consisting of particles with an aspect ratio of at least 10:1. More preferably the thermally conductive fibers consisting of particles with an aspect ratio of at least 15:1, more preferably at least 25:1. For the thermally conductive fibers in the thermally conductive plastic composition any fibers that improve the thermal conductivity of the plastic composition can be used. Suitably, the thermally conductive fibers comprise glass fibres, metal fibres and/or carbon fibres. Suitable carbon-fibres, also known as graphite fibres, include PITCH-based carbon fibre and PAN-based carbon fibres. For example, PITCH-based carbon fibre having an aspect ratio of about 50:1 can be used. PITCH-based carbon fibres contribute significantly to the heat conductivity. On the other hand PAN-based carbon fibres have a larger contribution to the mechanical strength. Most preferably, the thermally conductive fibers comprise or even consist of glass fibres. The advantage of glass fibres in the thermally conductive plastic composition from which the housing, or parts thereof, is made is that the housing has a good heat conductivity, increased mechanical strength and retains a good electrical isolation.

The thermally conductive plastic composition in the housing according to the invention suitably comprises 30-90 wt % of the thermoplastic polymer and 10-70 wt. % of the thermally conductive material, preferably 40-80 wt % of the thermoplastic polymer and 20-60 wt. % of the thermally conductive material, wherein the wt. % are relative to the total weight of the plastic composition.

Preferably, both low aspect and high aspect ratio thermally conductive materials, i.e. both thermally conductive fillers and fibres, are comprised by the plastic composition, as described in McCullough, U.S. Pat. Nos. 6,251,978 and 6,048,919, the disclosure of which are hereby incorporated by reference.

More preferably, the thermally conductive plastic composition comprises both glass fibres in combination with boron nitride and-or graphite, more preferably graphite. The advantage of graphite is an even higher thermal conductivity. Boron nitride is preferred for a better electrical insulation.

Still more preferably, glass fibres, boron nitride and graphite are present in a total amount of 10-70 wt. %, more preferably 20-60 wt. %, relative to the total weight of the plastic composition.

Also more preferable, the glass fibres and the total of boron nitride and graphite are present in a weight ratio between 5:1 and 1:5, preferably between 2.5:1 and 1:2.5.

The plastic composition, from which the housing according to the invention is made, may also comprise, next to the thermoplastic polymer and the thermally conductive material, also other components, denoted herein as additives. As additives, the thermally conductive material may comprise any auxiliary additive, known to a person skilled in the art that are customarily used in polymer compositions. Preferably, these other additives should not detract, or not in a significant extent, from the invention. Whether an additive is suitable for use in polymer composition can be determined by the person skilled in the art of making thermoconductive polymer compositions by routine experiments and simple tests. Such other additives include, in particular, non-conductive fillers and non-conductive reinforcing agents, pigments, dispersing aids, processing aids, for example lubricants and mould release agents, impact modifiers, plasticizers, crystallization accelerating agents, nucleating agents, UV stabilizers, antioxidants and heat stabilizers, and the like. In particular, the thermally conductive plastic composition contains a non-conductive inorganic filler and/or non-conductive reinforcing agent. Suitable for use as a non-conductive inorganic filler or reinforcing agent are all the fillers and reinforcing agents known to a person skilled in the art, and more particular auxiliary fillers, not considered thermally conductive fillers. Suitable non-conductive fillers are, for example asbestos, mica, clay, calcined clay and talcum.

These additives are suitably present, if any, in a total amount of 0-50 wt. %, preferably 0.5-25 wt. %, more preferably 1-12.5 wt. % relative to the total weight of the plastic composition.

The non-conductive fillers and fibres are preferably present, if any, in a total amount of 0-40 wt. %, preferably 0.5-20 wt. %, more preferably 1-10 wt. %, relative to the total weight of the composition, whereas the other additives are preferably present, if any, in a total amount of 0-10 wt. %, preferably 0.25-5 wt. %, more preferably 0.5-2.5 wt. %, relative to the total weight of the plastic composition.

In a preferred embodiment of the invention, the housing, or parts thereof, is made of a plastic composition consisting of:

a) 30-90 wt. % of thermoplastic polymer
b) 10-70 wt. % of thermally conductive material
c) 0-50 wt. % of additives wherein the wt. % of (a), (b) and (c) is relative to the total weight of the plastic composition a sum of (a), (b) and (c) is 100 wt. %.

More preferably, the plastic composition consists of:

a) 30-90 wt. % of thermoplastic polymer
b) 10-70 wt. % of thermally conductive material at least 50 wt. % thereof consist of glass fibres and boron nitride in a weight ratio between 5:1 and 1:5, and
c) (i) 0-40 wt. % of non-conductive fillers and/or non-conductive fibres, and
(ii) 0-10 wt. % of other additives wherein the wt. % of (a), (b), (c)(i) and (c)(ii) are relative to the total weight of the plastic composition a sum of (a), (b), (c)(i) and (c)(ii) is 100 wt. %.

Still more preferably, the plastic composition consists of:

a) 30-90 wt. % of a semi-crystalline polyamide with a melting point of at least 200° C.
b) 10-70 wt. % of thermally conductive material at least 50 wt. % thereof consist of glass fibres and graphite in a weight ratio between 5:1 and 1:5,
c) (i) 0-20 wt. % of non-conductive fillers and/or non-conductive fibres, and
(ii) 0-5 wt. % of other additives wherein the wt. % of (a), (b), (c)(i) and (c)(ii) are relative to the total weight of the plastic composition a sum of (a), (b), (c)(i) and (c)(ii) is 100 wt. %.

The thermally conductive plastic composition that is used for the present invention can be made by any process that is suitable for making plastic compositions and includes the conventional processes known by the person skilled in the art of making plastic compositions for melding applications.

The thermally conductive plastic composition suitable is made by a process wherein the thermally conductive material is intimately mixed with the non-conductive polymer matrix to form the thermally conductive composition. The loading of the thermally conductive material imparts thermal conductivity to the polymer composition. If desired, the mixture may contain one or more other additives. The mixture can be prepared using techniques known in the art. Preferably, the ingredients are mixed under low shear conditions in order to avoid damaging the structure of the thermally conductive filler materials.

The housing according to the invention can be made from the thermally conductive plastic composition by any process that is suitable for making moulded plastic parts and includes the conventional processes known by the person skilled in the art of making moulded plastic compositions.

The polymer composition can be moulded into a part for the housing a melt-extrusion, injection moulding, casting, or other suitable process. An injection-melding process is particularly preferred. This process generally involves loading pellets of the composition into a hopper. The hopper funnels the pellets into an extruder, wherein the pellets are heated and a molten composition forms. The extruder feeds the molten composition into a chamber containing an injection piston. The piston forces the molten composition into a mould. Typically, the mould contains two moulding sections that are aligned together in such a way that a moulding chamber or cavity is located between the sections. The material remains in the mould under high pressure until it cools. The shaped part is then removed from the mould.

Preferably, the housing part is made from a thermally conductive plastic composition comprising thermally conductive fibres and thermally conductive fillers by an injection melding process.

Further, the housing of this invention preferably is net shape moulded. This means that the final shape of the socket is determined by the shape of the moulding sections. No additional processing or tooling is required to produce the ultimate shape of the housing. This moulding process enables the integration of the thermally dissipating elements directly into the housing.

This invention relates also relates to the use of the lighting armature according to the present invention, or any preferred embodiment thereof as described herein above, in an automotive lamp assembly or in an office building. The automotive lamp assembly preferably is for automotive exterior lighting, for example, for front lighting or rear lighting.

The invention claimed is:

1. A lighting armature comprising:
a housing having cooling fins;
a light source within the housing; and
drive electronics within the housing for driving the light source, wherein
the cooling fins are made of a plastic composition comprising a polymer arid thermally conductive material dispersed in the polymer, the plastic composition having an orientation averaged thermal conductivity of at least 2.0-15 W/m·K.

2. The lighting armature according to claim 1, wherein the cooling fins are made from a thermoplastic material having a through-plane conductivity in the range of 1 to 10 m·K, and wherein the cooling fins have height (H) and thickness (T) dimensions such that a ratio is at least 3:1.

3. The lighting armature according to claim 1, wherein the light source comprises LEDs mounted on a metal core printed circuit board (MC-PCB).

4. The lighting armature according to claim 1, wherein the housing comprises a metal shield with a first surface oriented towards the drive electronics and a second surface directed towards the cooling fins, and wherein the metal shield and the cooling fins are in direct heat conductive contact.

5. The lighting armature according to claim 1, wherein the cooling fins constitute elongated elements of a plastic body comprising a plastic shield having a surface from which the elongated elements protrude.

6. The lighting armature according to claim 5, wherein the plastic body is an integrally moulded part made of a plastic composition having an orientation averaged thermal conductivity of more than 20 W/m·K.

7. The lighting armature according to claim 6, wherein the integrally moulded part and the light source are connected via a heat-conductive electrically insulating material.

8. The lighting armature according to claim 5, wherein the plastic body is a 2K moulded part comprising a layer made of a first plastic composition having an orientation averaged thermal conductivity of more than 20 W/m·K, and fins made of a second plastic composition having an orientation averaged thermal conductivity of 2.0-15 W/m·K.

9. The lighting armature according to claim 1, wherein the lighting armature accommodates parts of electrical power supply means and an electrically insulating plastic shield made of an electrically insulating material, whereby the electrically insulating plastic shield is positioned in between the electrical power supply means and the housing.

10. A housing for a lighting armature, the housing having cooling fins and being suitable for accommodating a light source and drive electronics for driving the light source, wherein the cooling fins are made of a plastic composition having an orientation averaged thermal conductivity of at least 2.0-15 W/m·K.

* * * * *